US010227871B2

(12) United States Patent
Dickey et al.

(10) Patent No.: US 10,227,871 B2
(45) Date of Patent: Mar. 12, 2019

(54) SPRAY SYSTEM FOR MINING MACHINE

(71) Applicant: Joy MM Delaware, Inc., Wilmington, DE (US)

(72) Inventors: Ryan Dickey, Grove City, PA (US); Zane McGill, Utica, PA (US); Joshua Lutz, Mercer, PA (US); Matthew Hayes, Franklin, PA (US)

(73) Assignee: Joy Global Underground Mining LLC, Warrendale, PA (US)

( * ) Notice: Subject to any disclaimer, the term of this patent is extended or adjusted under 35 U.S.C. 154(b) by 186 days.

(21) Appl. No.: 15/182,440

(22) Filed: Jun. 14, 2016

(65) Prior Publication Data

US 2016/0362979 A1 Dec. 15, 2016

Related U.S. Application Data

(60) Provisional application No. 62/175,879, filed on Jun. 15, 2015.

(51) Int. Cl.

| | |
|---|---|
| ***E21C 35/22*** | (2006.01) |
| ***E21F 5/02*** | (2006.01) |
| ***E21C 35/23*** | (2006.01) |
| ***E21C 31/08*** | (2006.01) |
| ***E21C 27/10*** | (2006.01) |
| *B05B 15/68* | (2018.01) |
| *B05B 1/20* | (2006.01) |

(52) U.S. Cl.

CPC ..... *E21C 35/23* (2013.01); *E21C 27/10* (2013.01); *E21C 31/08* (2013.01); *E21C 35/22* (2013.01); *E21F 5/02* (2013.01); *B05B 1/20* (2013.01); *B05B 15/68* (2018.02)

(58) Field of Classification Search

CPC .... E21C 35/22; E21C 2035/226; E21C 29/02; E21F 5/02; E21F 5/04; B05B 1/20; E01C 23/088; E01C 23/127; E01C 2301/50

USPC ..... 239/159, 160, 161, 163, 164, 165, 166, 239/167, 168

See application file for complete search history.

(56) References Cited

U.S. PATENT DOCUMENTS 2,548,209 A * 4/1951 Foster ..... A01M 7/0078 239/167
4,199,299 A 4/1980 Petitto, Sr. et al.
4,358,160 A * 11/1982 Kissell ..... E21C 35/22 299/12

(Continued)

*Primary Examiner* — David J Bagnell
*Assistant Examiner* — Michael A Goodwin
(74) *Attorney, Agent, or Firm* — Michael Best & Friedrich LLP

(57) ABSTRACT

A mining machine includes a chassis, a cutting assembly coupled to the chassis, and a spray arm coupled to the chassis and positioned proximate the cutting assembly. The chassis includes a first end, a second end, and a chassis axis extending between the first end and the second end. The chassis is movable in a direction parallel to the chassis axis. The cutting assembly includes an arm and a rotatable cutting drum having a plurality of cutting elements. The spray arm includes a first portion, a second portion pivotably coupled to the first portion, and at least one spray nozzle for emitting a fluid spray in a region adjacent the cutting assembly. The first portion is coupled to the chassis and extends away from the chassis along a spray arm axis. The second portion is pivotable relative to the first portion about a wrist axis.

18 Claims, 11 Drawing Sheets

(56) References Cited

U.S. PATENT DOCUMENTS

| | | | | |
|---|---|---|---|---|
| 4,375,904 | A | 3/1983 | Beckmann et al. | |
| H23 | H | 2/1986 | Riester et al. | |
| 4,714,293 | A | 12/1987 | Watson | |
| 5,219,208 | A | 6/1993 | Liao et al. | |
| 5,518,299 | A | 5/1996 | Adamczyk et al. | |
| 8,864,048 | B1 * | 10/2014 | Light | B05B 1/20 239/159 |
| 2007/0131791 | A1 * | 6/2007 | Peterson | A01M 7/0078 239/166 |
| 2010/0237683 | A1 * | 9/2010 | Mundry | E21C 35/22 299/42 |

* cited by examiner

SPRAY SYSTEM FOR MINING MACHINE

REFERENCE TO RELATED APPLICATION

This application claims the benefit of prior-filed, U.S. Provisional Patent Application No. 62/175,879, filed Jun. 15, 2015, the entire contents of which are hereby incorporated by reference

BACKGROUND

The present disclosure relates to the field of mining machines and particularly a fluid spray system for a mining machine.

A conventional mining machine such as a longwall shearer includes a cutting drum rotating about an axis that is generally perpendicular to a mine face. The cutting drum includes a plurality of cutting bit assemblies positioned along a vane of the cutting drum in a spiral or helical manner. The engagement of the cutting drum against the mine face generates dust and/or particulates. In addition, the engagement of the cutting bits may cause sparking, which creates a danger of igniting flammable gases in the mine environment.

SUMMARY

In one aspect, a mining machine includes a chassis, a first cutting assembly, a second cutting assembly, and a spray arm. The chassis includes a first end, a second end, and a chassis axis extending between the first end and the second end. The chassis is movable in a direction parallel to the chassis axis. The first cutting assembly is coupled to the chassis and includes a first arm and a first cutting drum supported by the first arm for rotation relative to the first arm. The first cutting drum includes a plurality of first cutting elements. The second cutting assembly is coupled to the chassis and includes a second arm and a second cutting drum supported by the second arm for rotation relative to the second arm. The second cutting drum includes a plurality of second cutting elements. The spray arm is pivotably coupled to the chassis and positioned proximate the first cutting assembly. The spray arm includes a first end and a second end. The first end is pivotable relative to the chassis about a spray arm pivot axis oriented transverse to the chassis axis. The spray arm further includes at least one spray nozzle for emitting a fluid spray in a region adjacent the first cutting assembly.

In another aspect, a mining machine includes a chassis, a cutting assembly coupled to the chassis, and a spray arm coupled to the chassis and positioned proximate the cutting assembly. The chassis includes a first end, a second end, and a chassis axis extending between the first end and the second end. The chassis is movable in a direction parallel to the chassis axis. The cutting assembly includes an arm and a cutting drum supported by the arm for rotation relative to the arm. The cutting drum includes a plurality of cutting elements. The spray arm includes a first portion, a second portion pivotably coupled to the first portion, and at least one spray nozzle for emitting a fluid spray in a region adjacent the cutting assembly. The first portion is coupled to the chassis and extends away from the chassis along a spray arm axis. The second portion is pivotable relative to the first portion about a wrist axis.

In yet another aspect, a spray system is provided for a mining machine including a chassis and a cutting assembly pivotably coupled to the chassis. The spray system includes an elongated base member, a distal member, and an intermediate portion positioned between the base member and the distal member. The base member includes a first end, a second end, and an arm axis extending between the first end and the second end. The first end is configured to be coupled to the chassis. The distal member includes a plurality of spray nozzles for emitting a fluid spray. The distal member is pivotable relative to the base member about a wrist axis that is perpendicular to the arm axis. The intermediate portion includes a first side and a second side opposite the first side. The first side is pivotably coupled to the second end of the first member, and the second side is pivotably coupled to the distal member.

Other aspects will become apparent by consideration of the detailed description and accompanying drawings.

DETAILED DESCRIPTION

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

Figure 1:
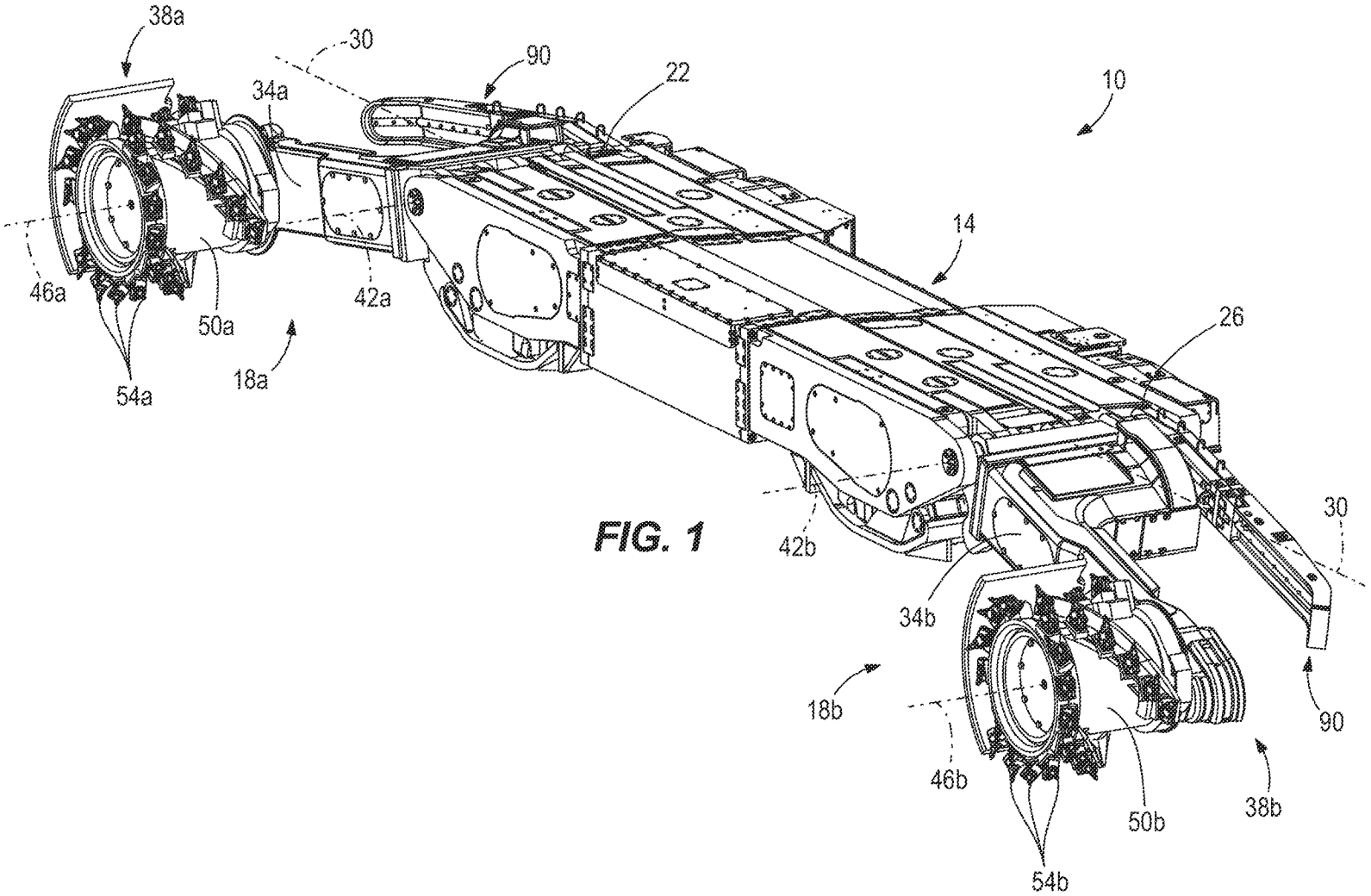
FIG. 1 is a forward perspective view of a mining machine.

FIG. 1 illustrates a mining machine 10. In the illustrated embodiment, the mining machine 10 is a longwall shearer including a frame or chassis 14 and a pair of cutting assemblies 18. The chassis 14 includes a first end 22, a second end 26, and a chassis axis 30 extending between the first end 22 and the second end 26. The chassis 14 is movable in a direction substantially parallel to the chassis axis 30. Each cutting assembly 18 includes a ranging arm 34 and a cutter head 38. One end of each ranging arm 34 is coupled to one of the ends 22, 26 of the chassis 14 and is pivotable about an cutter pivot axis 42. Another end of each ranging arm 34 supports the cutter head 38 for rotation about a drum axis 46. The ranging arm 34 is pivoted relative to the chassis 14 in order to raise or lower the cutter head 38. In the illustrated embodiment, each cutter head 38 includes a drum 50 having spiral or helical vanes extending along an outer periphery of the drum 50. A plurality of cutting bit assemblies 54 are secured to each vane and to an end ring positioned adjacent the distal end of the cutting drum 50.

Figure 2:
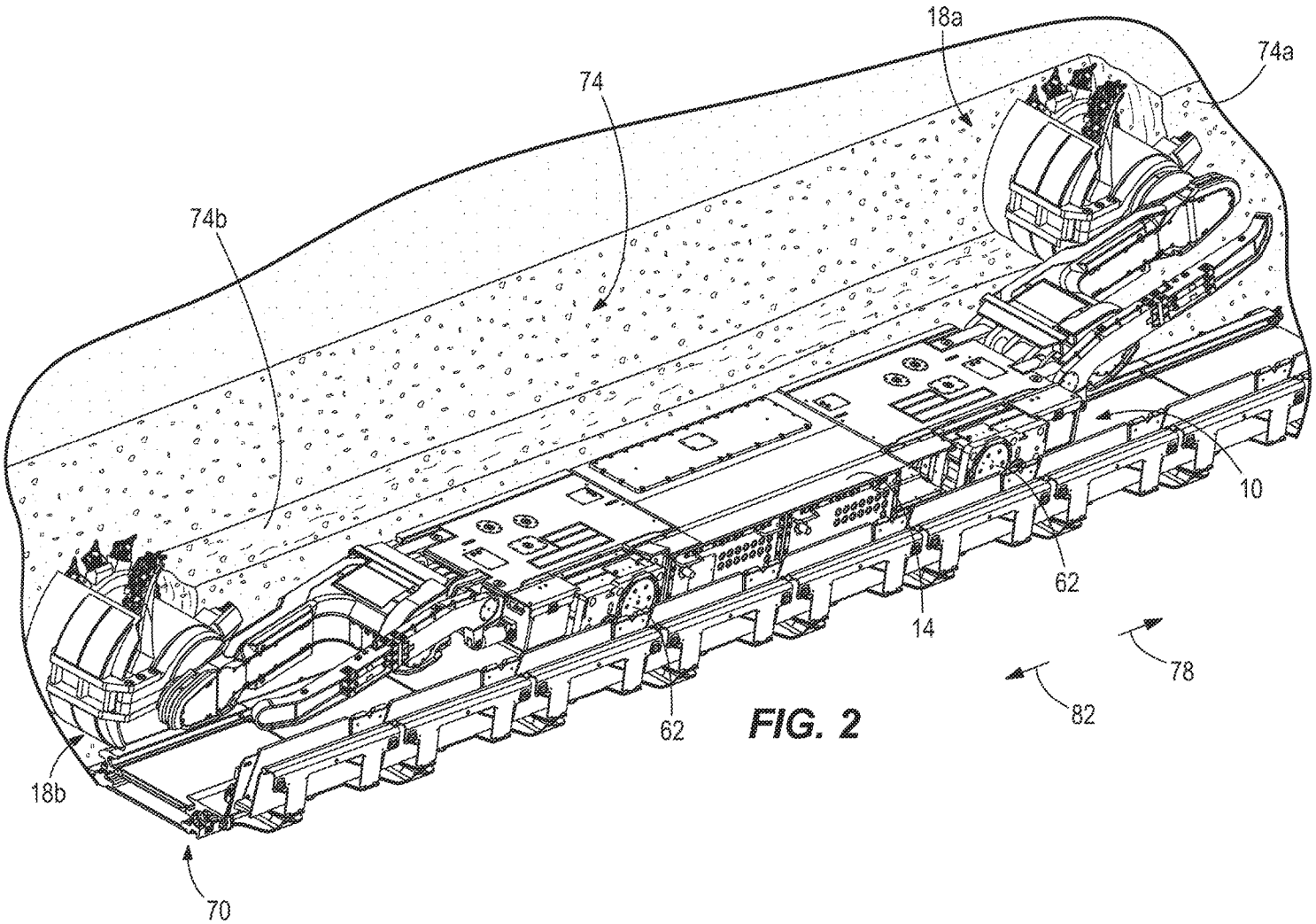
FIG. 2 is a rear perspective view of the mining machine of FIG. 1 and a mine face.

As shown in FIG. 2, the mining machine 10 also includes a drive mechanism 62. In the illustrated embodiment, the drive mechanism 62 is positioned proximate a rear or gob or goaf side of the chassis 14, while the cutter head 38 is positioned proximate a forward or face side of the chassis 14. In some embodiments, the drive mechanism 62 includes a sprocket (not shown) driven by a motor on the chassis 14 and engaging a rack (not shown) to form a rack and pinion connection. In the illustrated embodiment, the rack is coupled to a face conveyor 70 positioned below the machine 10 to receive the material cut from a mine face 74. The rotation of the sprocket causes the machine 10 to tram or move along the face conveyor 70 in a first direction 78 or a second direction 82 opposite the first direction 28.

As the chassis 14 moves in the first direction 78, a first cutting assembly 18*a* is in a leading position and a second cutting assembly 18*b* is in a trailing position. In the illustrated embodiment, the first cutting assembly 18*a* is elevated to cut material (e.g., coal or other minerals) from an upper portion 74*a* of the mine face 74, while the second cutting assembly 18*b* is in a lower position to cut material from a lower portion 74*b* of the mine face 74.

Figure 3:
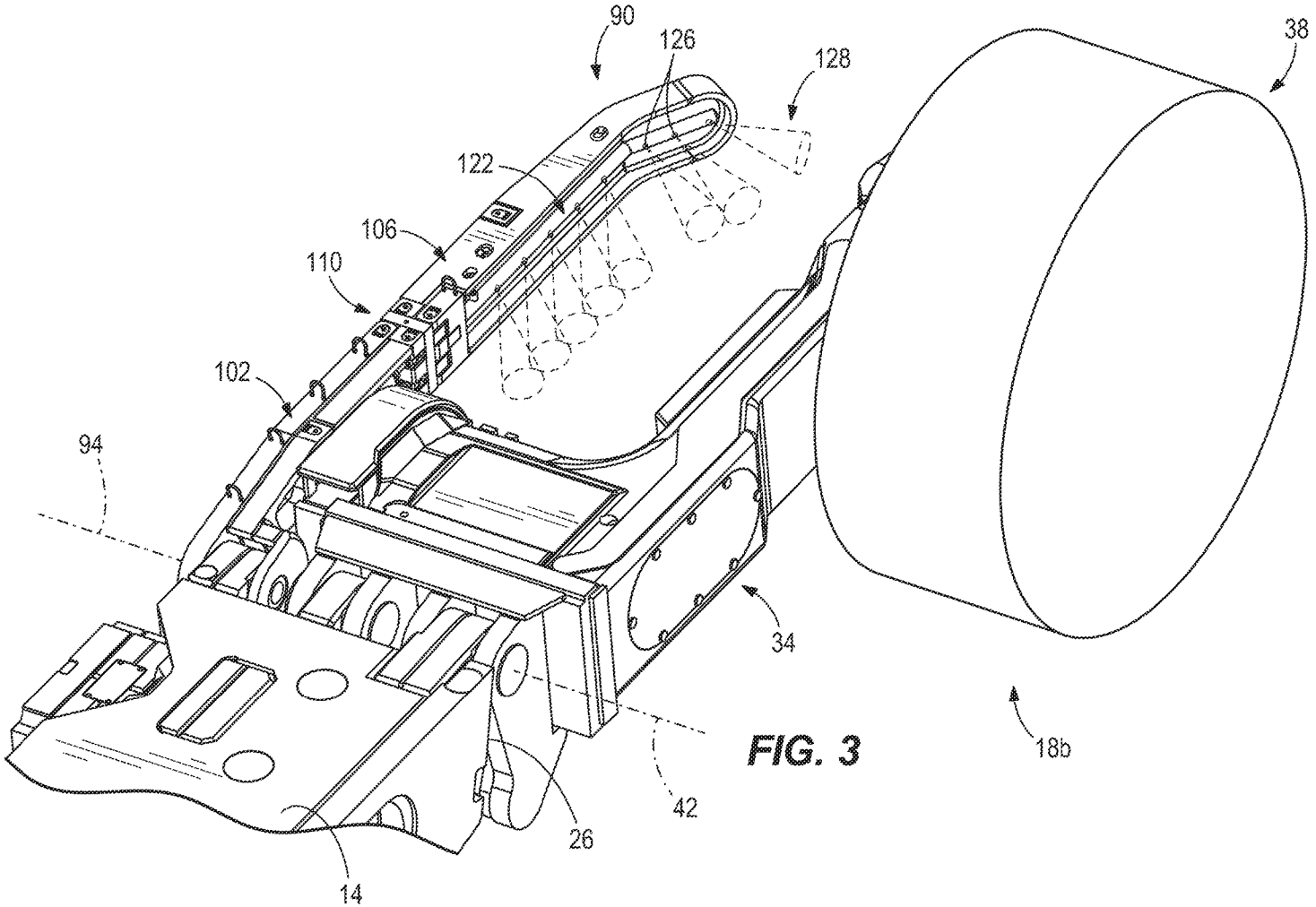
FIG. 3 is a perspective view of a portion of a chassis, a cutting assembly, and a boom of a spray system.
Figure 4:
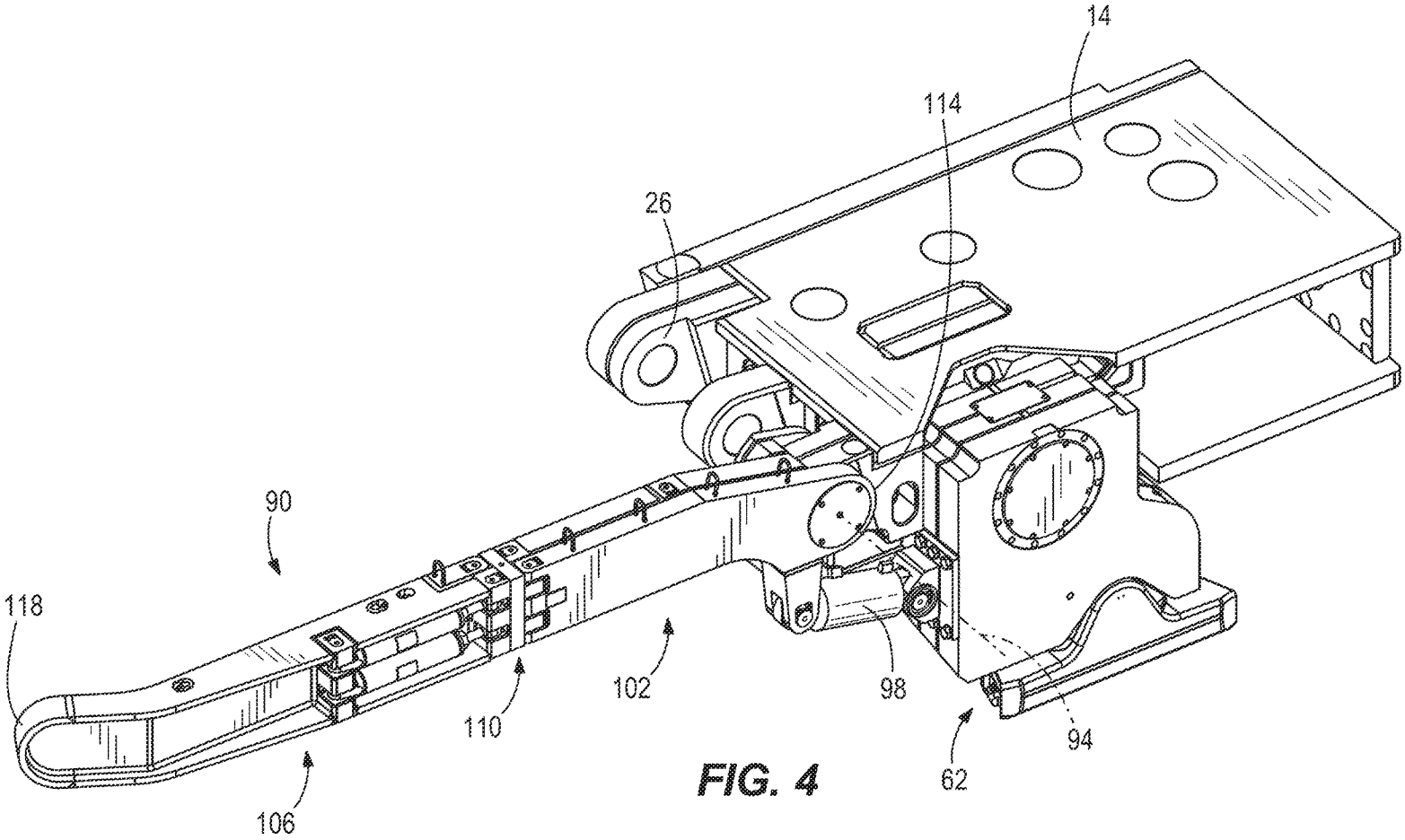
FIG. 4 is a rear view of the portion of the chassis and the boom of FIG. 3, with the cutting assembly removed.

Referring now to FIGS. 3 and 4, the longwall shearer 10 further includes a spray system including a spray arm or spray boom 90 coupled to the second end 26 of the chassis 14 adjacent the second cutting assembly 18*b* (FIG. 3). A similar boom 90 is coupled to the first end 22 (FIG. 1) of the chassis 14 adjacent the first cutting assembly 18*a*. For the sake of brevity, only the boom 90 coupled to the second end 26 will be described in detail. Also, for sake of simplicity, the cutter head 38 is illustrated as a cylinder in FIG. 3.

Figure 5:
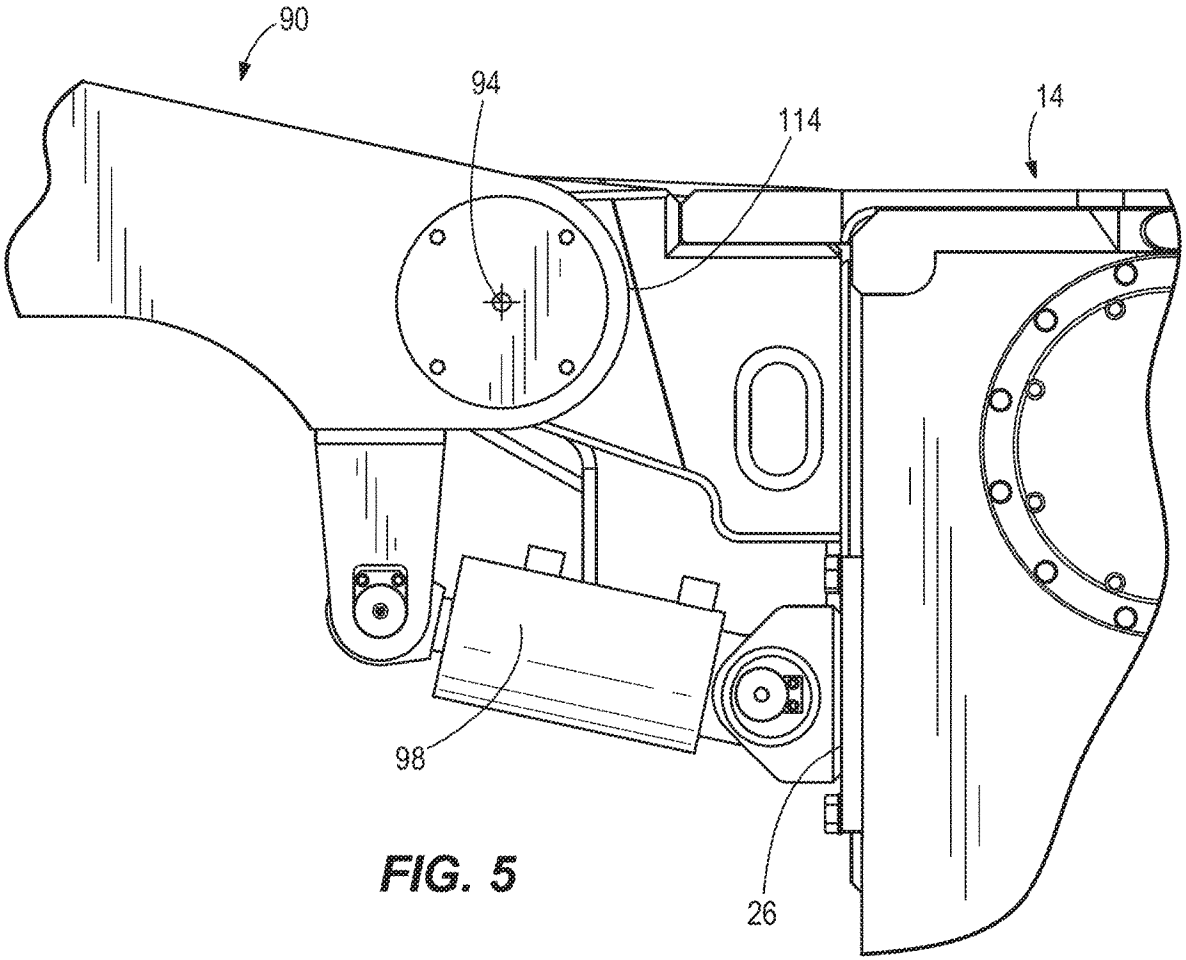
FIG. 5 is an enlarged side view of a portion of the chassis and the boom of FIG. 4.

As shown in FIGS. 4 and 5, the mining machine 10 further includes a pivot actuator 98 for pivoting the boom 90 relative to the chassis 14 about a boom pivot axis 94. In the illustrated embodiment, the pivot actuator 98 is a fluid cylinder having a first end coupled to the chassis 14 and a second end coupled to the boom 90. The boom pivot axis 94 is generally parallel to the cutter pivot axis 42. The boom 90 is pivotable relative to the chassis 14 independent of the ranging arm 34 of the cutting assembly 18 (FIG. 3). The boom 90 is pivotable relative to the chassis 14 within a plane that is generally parallel to the mine face 74 (FIG. 2). Stated another way, the boom 90 is pivotable relative to the chassis 14 in a plane that is parallel to the direction of movement 78, 82 (FIG. 2) of the chassis 14. Stated yet another way, the boom pivot axis 94 is both perpendicular to the direction of movement 78, 82 (FIG. 2) of the chassis 14 and parallel to a plane oriented parallel to the chassis 14 and extending from the mine face 74 to the gob side of the mine. In one embodiment, the boom 90 and pivot actuator 98 are positioned adjacent the drive mechanism 62 (FIG. 4).

Figure 7:
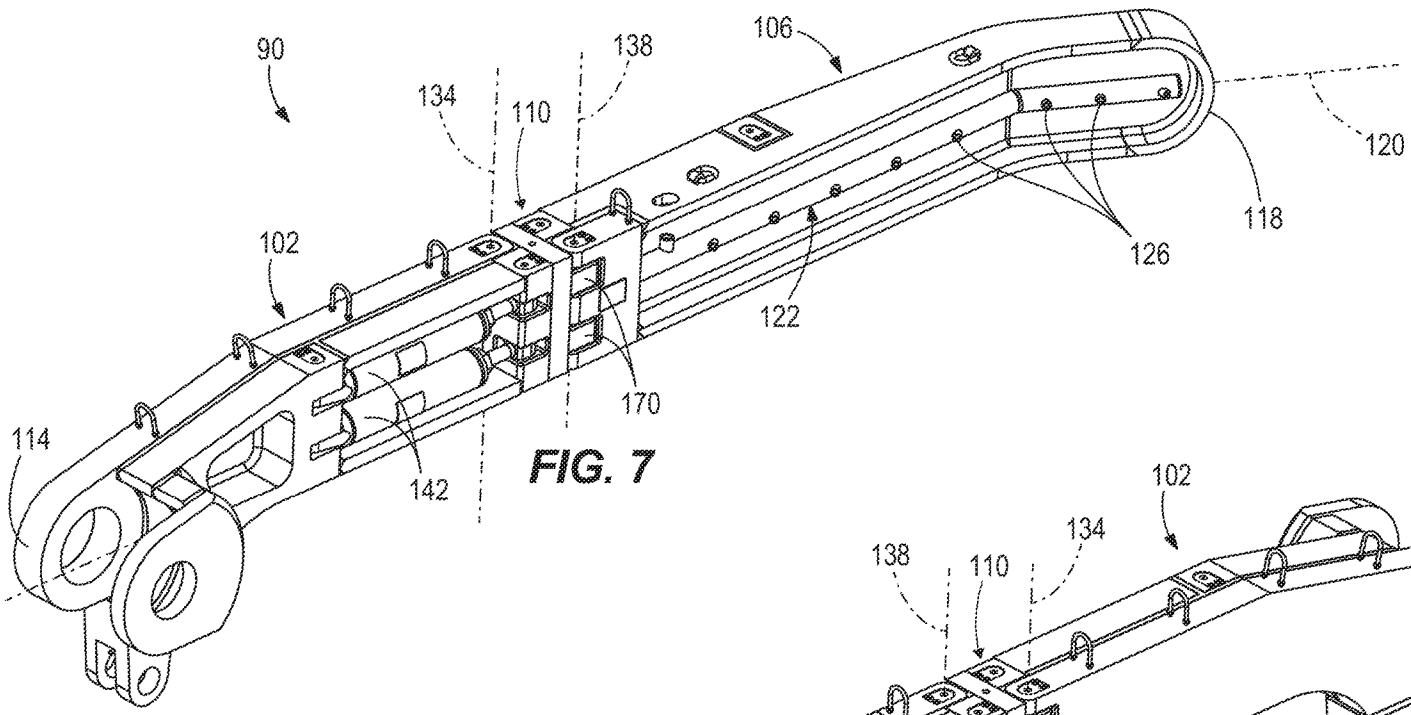
FIG. 7 is a forward perspective view of the boom of FIG. 3.
Figure 6:
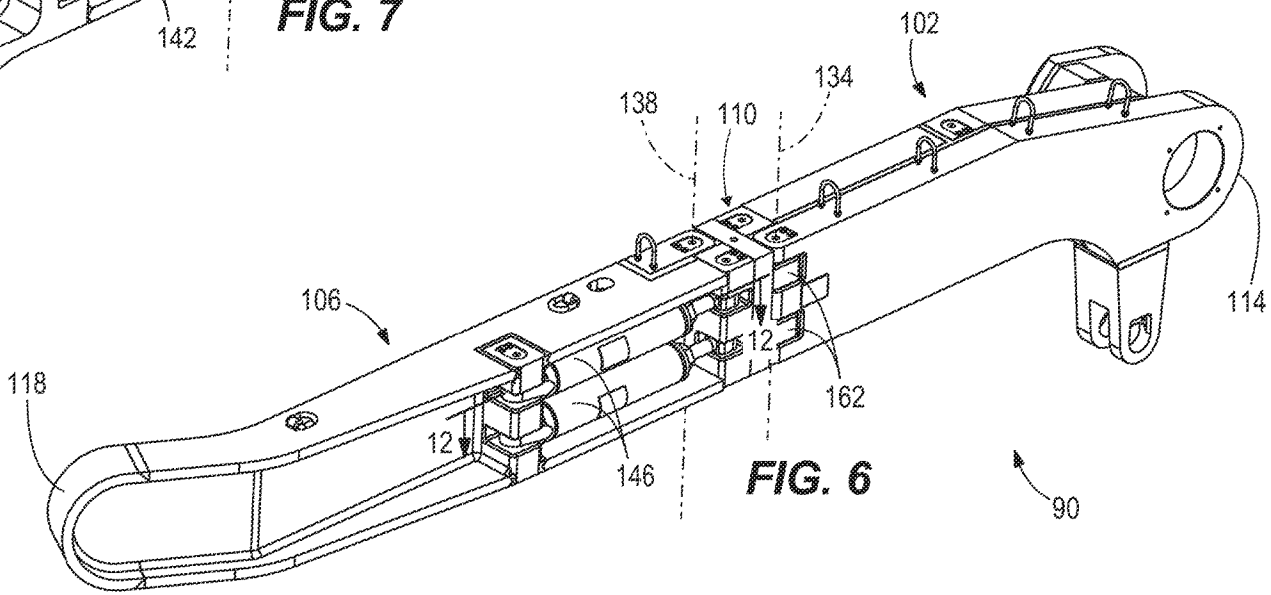
FIG. 6 is a rear perspective view of the boom of FIG. 3.

Referring now to FIGS. 6 and 7, the boom 90 includes a base member or first portion 102, a distal member or second portion 106, and an intermediate portion or joint 110 coupling the first portion 102 and the second portion 106. The first portion 102 includes a first end 114 directly coupled to the chassis 14 and the first portion 102 is also coupled to the pivot actuator 98. The second portion 106 includes a distal end or second end 118 distal with respect to the chassis 14. The boom 90 is supported by the chassis 14 in a cantilevered condition. In the illustrated embodiment, a boom axis or centerline 120 (FIG. 7) extends along the boom 90 from the first end 114 to the second end 118 and defines a generally straight line. In the illustrated embodiment, a portion of the boom centerline 120 extending through the first portion 102 and the joint 110 is substantially linear when the boom 90 is in the neutral position. While the second portion 106 is also substantially straight, and a portion proximate the second end 118 forms an angle relative to the rest of the second portion 106 and relative to the first portion 102.

As shown in FIGS. 3 and 7, a manifold 122 is positioned on a side of the second portion 106 proximate the cutting assembly 18 (FIG. 3). In the illustrated embodiment, the manifold 122 is formed as an elongated tube and includes a plurality of spray nozzles 126 spaced apart along the tube. The manifold 122 provides a conduit for providing fluid (e.g., water) to the spray nozzles 126. The nozzles 126 emit the fluid to a form a spray curtain 128 (FIG. 3) extending at least partially around the cutter head 38. In the illustrated embodiment, the nozzles 126 emit fluid in a spray pattern having a conical shape; in other embodiments, the spray pattern may have a different shape.

Referring again to FIGS. 6 and 7, in the illustrated embodiment, the joint 110 is a bi-directional, double-hinged joint. The joint 110 provides multiple points of articulation for the boom 90. For example, the second portion 106 may pivot relative to the first portion 102 about a first wrist axis 134 or a second wrist axis 138, depending on the direction of rotation. The wrist axes 134, 138 are oriented parallel to the plane of movement of the boom 90 as the boom 90 pivots about the boom pivot axis 94. Stated another way, the wrist axes 134, 138 are offset from and oriented perpendicular to the boom pivot axis 94. In other embodiments, the joint 110 may have a different construction and/or may permit movement of the second portion 106 in a different manner.

The boom 90 further includes biasing members or struts 142, 146 for biasing the movement of the second portion 106. First struts 142 (FIG. 7) are coupled between the first portion 102 and the joint 110, and second struts 146 (FIG. 6) are coupled between the second portion 106 and the joint 110. In the illustrated embodiment, the boom 90 includes two first struts 142 and two second struts 146; in other embodiments, the boom 90 may include fewer or more struts. Also, in the illustrated embodiment, the second struts 146 are positioned on a side of the second portion 106 opposite the manifold 122.

Figure 8:
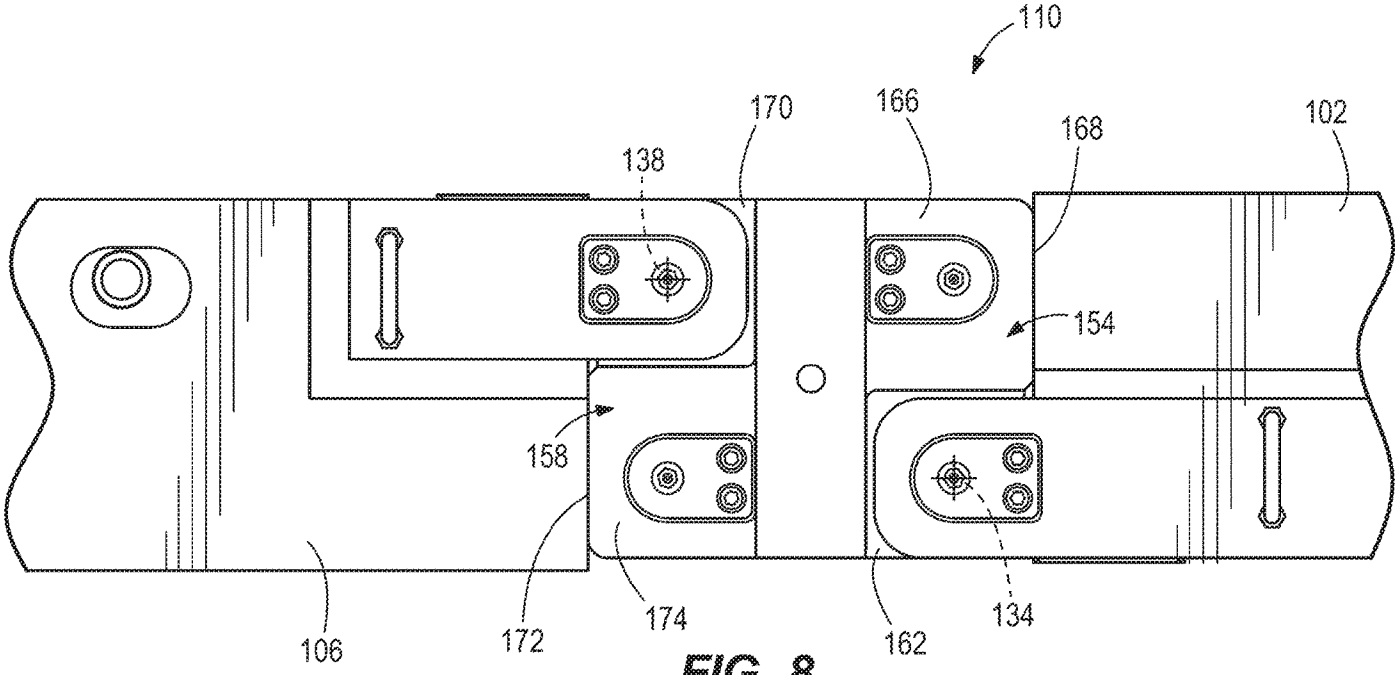
FIG. 8 is a top view of a joint of the boom of FIG. 3.

Referring now to FIG. 8, the joint 110 includes a first side 154 and a second side 158. Each side 154, 158 includes a pair of connection points or lugs. The first side 154 includes a base primary lug 162 and a base secondary lug 166, and the second side 158 includes a distal primary lug 170 and a distal secondary lug 174. The base primary lug 162 is pivotably coupled to the first portion 102 of the boom 90. The base primary lug 162 pivots relative to the first portion 102 about the first wrist axis 134. The base secondary lug 166 is coupled to the first struts 142, which exert a biasing force on the joint 110 (and therefore also the second portion 106) about the first wrist axis 134. In the illustrated embodiment, a side surface 168 of the base secondary lug 166 acts as a stop surface, abutting an end surface of the first portion 102 to prevent rotation of the joint 110 about the first wrist axis 134 beyond a predetermined position.

Similarly, the distal primary lug 170 is pivotably coupled to the second portion 106 of the boom 90, permitting the second portion 106 to pivot relative to the joint 110 about the second wrist axis 138. The distal secondary lug 174 is coupled to the second struts 146, which exert a biasing force on the second portion 106 about the second wrist axis 138. In the illustrated embodiment, a side surface 172 of the distal secondary lug 174 acts a stop surface, abutting an end surface of the second portion 106 to prevent rotation of the second portion 106 about the second wrist axis 138 beyond a predetermined position.

Figures 9A, 9B, 9C:
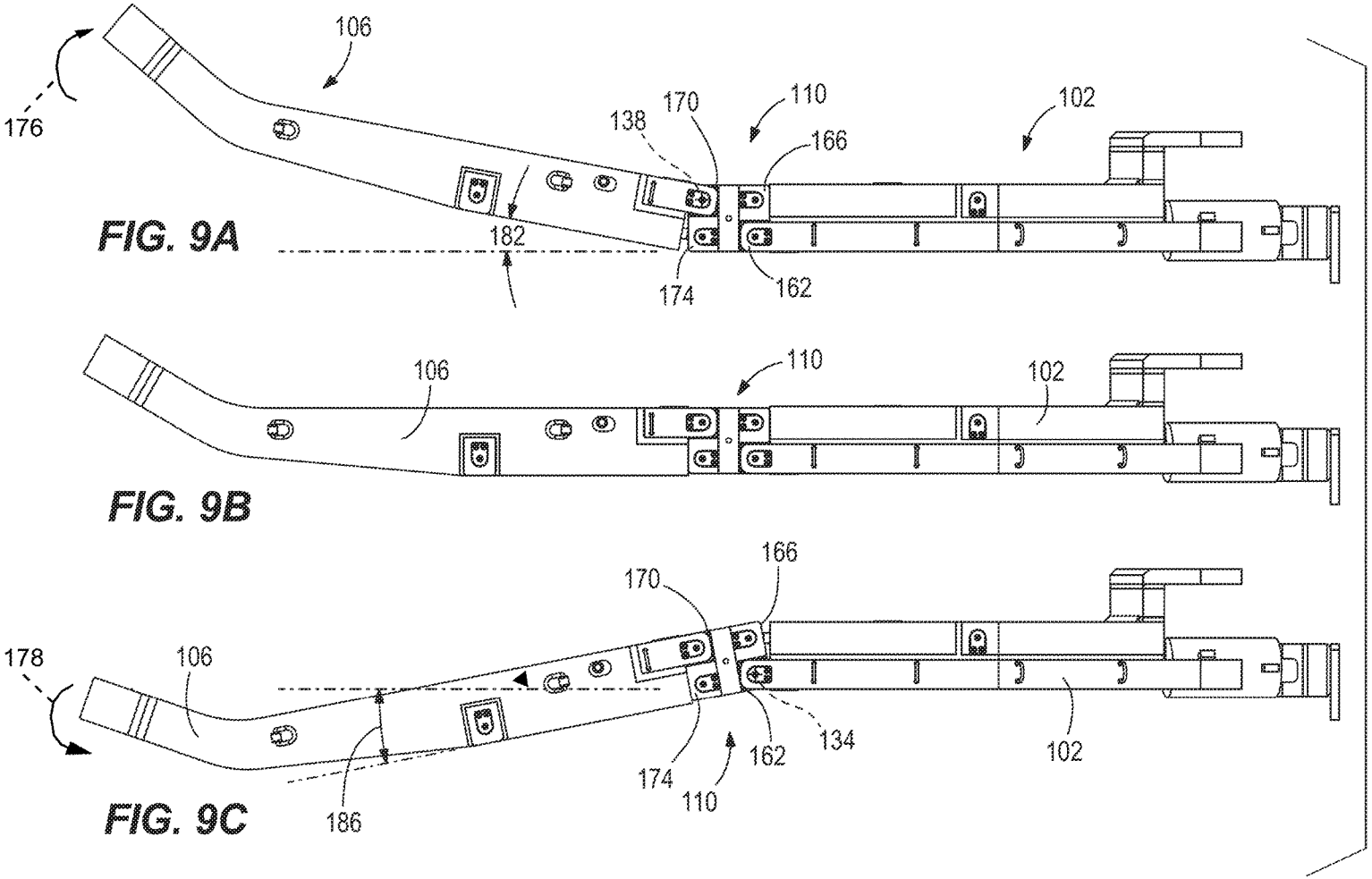
FIG. 9A is a top view of the boom of FIG. 3 in a first position.
FIG. 9B is a top view of the boom of FIG. 3 in a neutral position.
FIG. 9C is a top view of the boom of FIG. 3 in a second position.

As shown in FIGS. 9A-9C, when the second portion 106 of the boom 90 pivots in a first direction 176 (e.g., clockwise in FIG. 9A), the joint 110 remains stationary relative to the first portion 102, and the second portion 106 pivots about the distal primary lug 170 of the joint 110 and about the second wrist axis 138. When the second portion 106 pivots in a second direction 178 opposite the first direction 176 (e.g., counter-clockwise in FIG. 9C), the joint 110 moves with the second portion 106 and pivots about the base primary connection 162 and about the first wrist axis 134. In the illustrated embodiment, pivoting the second portion 106 in the first direction 176 places the second portion 106 in flexion relative to a neutral position (FIG. 9B), while pivoting the second portion 106 in the second direction 178 places the second portion 106 in extension relative to the neutral position. The second portion 106 pivots about a different axis when the second portion 106 moves in the first direction 176 than when it pivots in the second direction 178; however, in both directions, the axis of rotation (i.e., wrist axes 134, 138) is oriented in the same direction.

The second portion 106 pivots in the first direction 176 through a flexion angle or first angle 182 about the second wrist axis 138 and pivots in the second direction 178 through an extension angle or second angle 186 about the first wrist axis 134. In the illustrated embodiment, the maximum flexion angle 182 is approximately 10.6 degrees relative to the neutral position (i.e., the second portion 106 can pivot approximately 10.6 degrees toward the cutter head 38 (FIG. 3) about the second wrist axis 138). In the illustrated embodiment, the second portion 106 can pivot through a maximum extension angle of approximately 11.1 degrees relative to the neutral position (i.e., the second portion 106 can pivot approximately 11.1 degrees away from the cutter head 38 (FIG. 3) about the first wrist axis 134).

Figure 10:
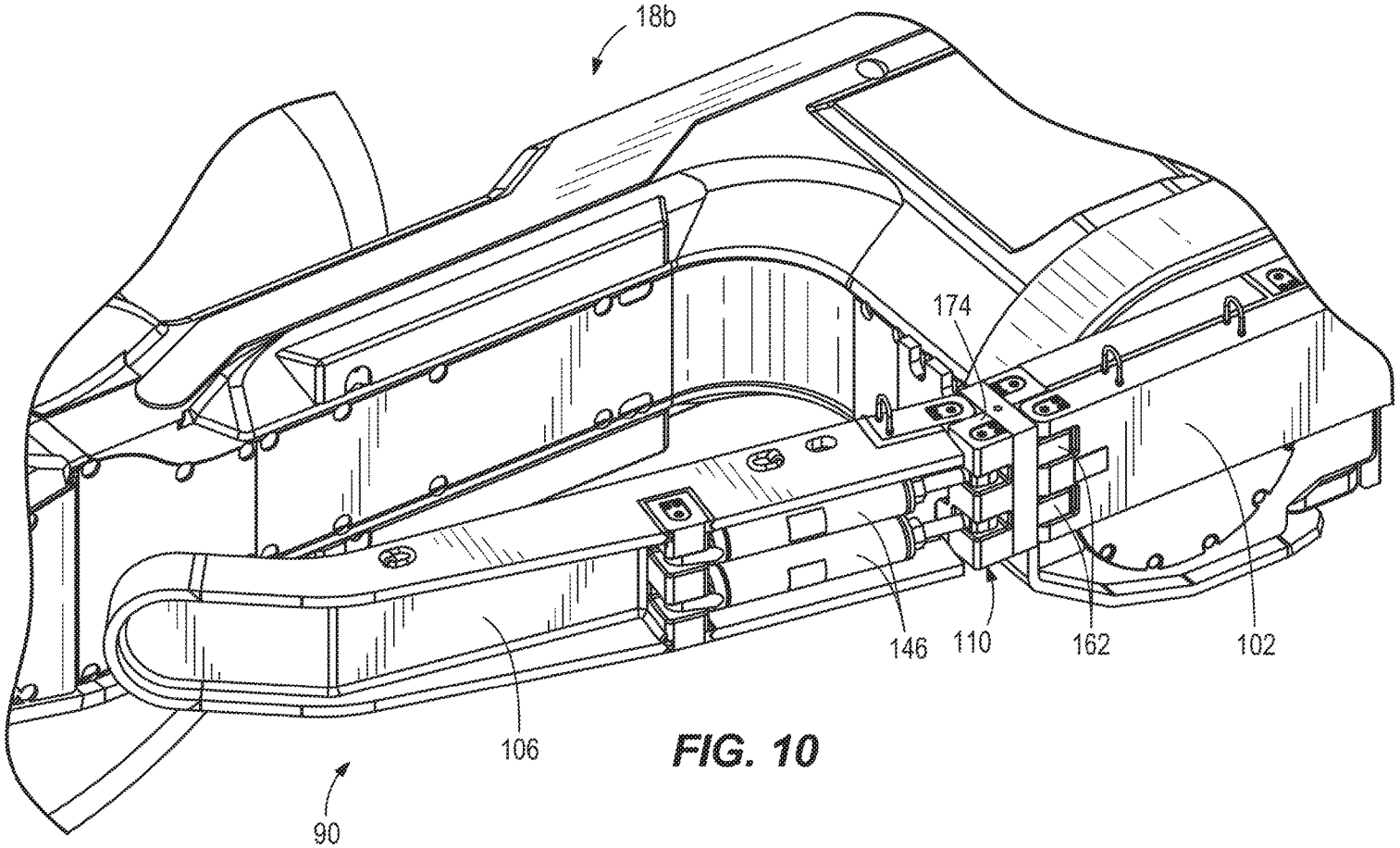
FIG. 10 is a rear perspective view of the boom in the first position of FIG. 9A.
Figure 11:
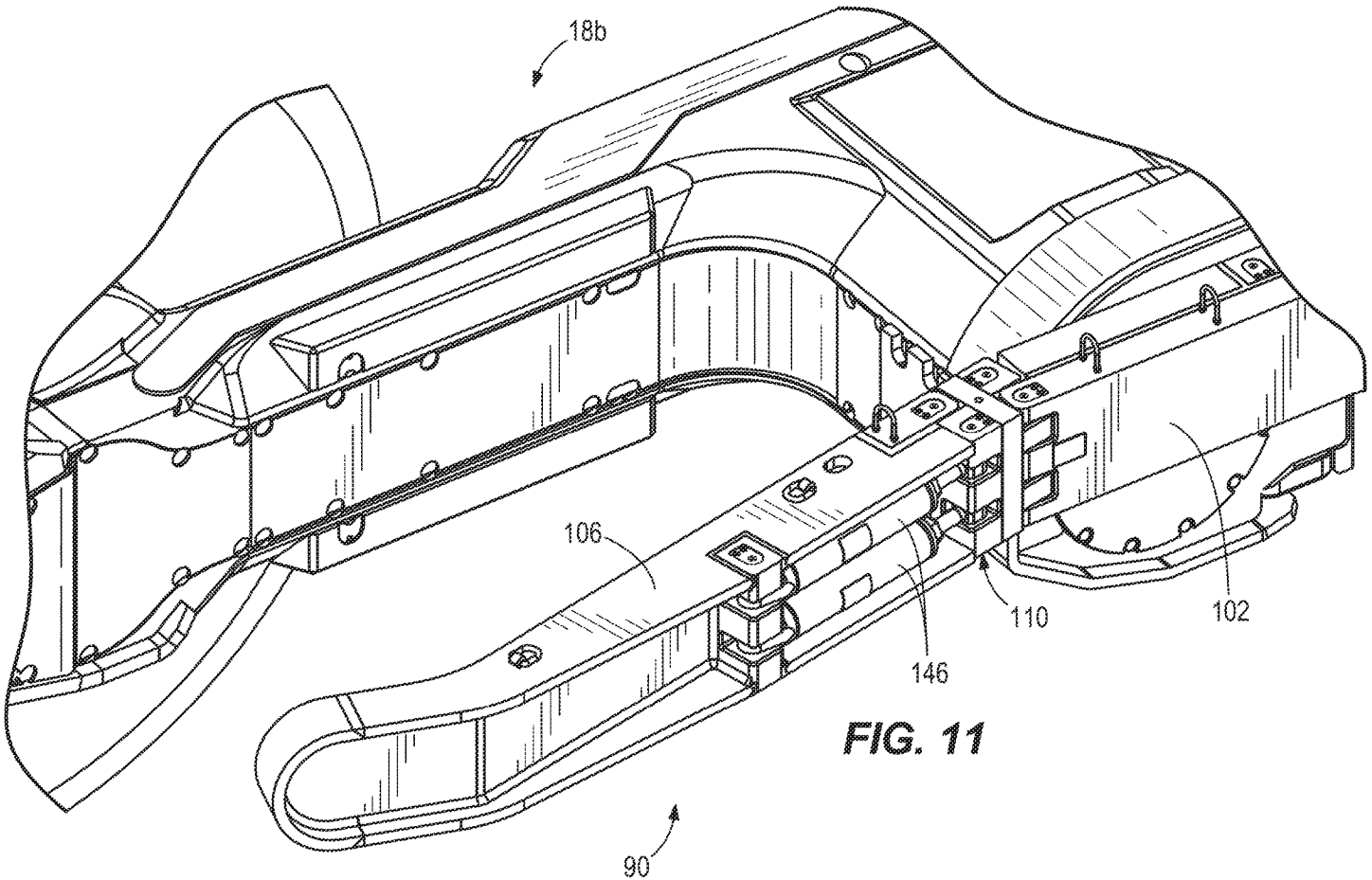
FIG. 11 is a rear perspective view of the boom in the second position of FIG. 9C.

FIGS. 10 and 11 illustrate the flexion condition (FIG. 10) and extension condition (FIG. 11) of the boom 90 relative to the cutting assembly 18*b*. As the second portion 106 moves toward the flexion condition, the second portion 106 moves toward the cutting assembly 18*b*. As the second portion 106 moves toward the extension condition, the second portion 106 moves away from the cutting assembly 18.

Figure 12:
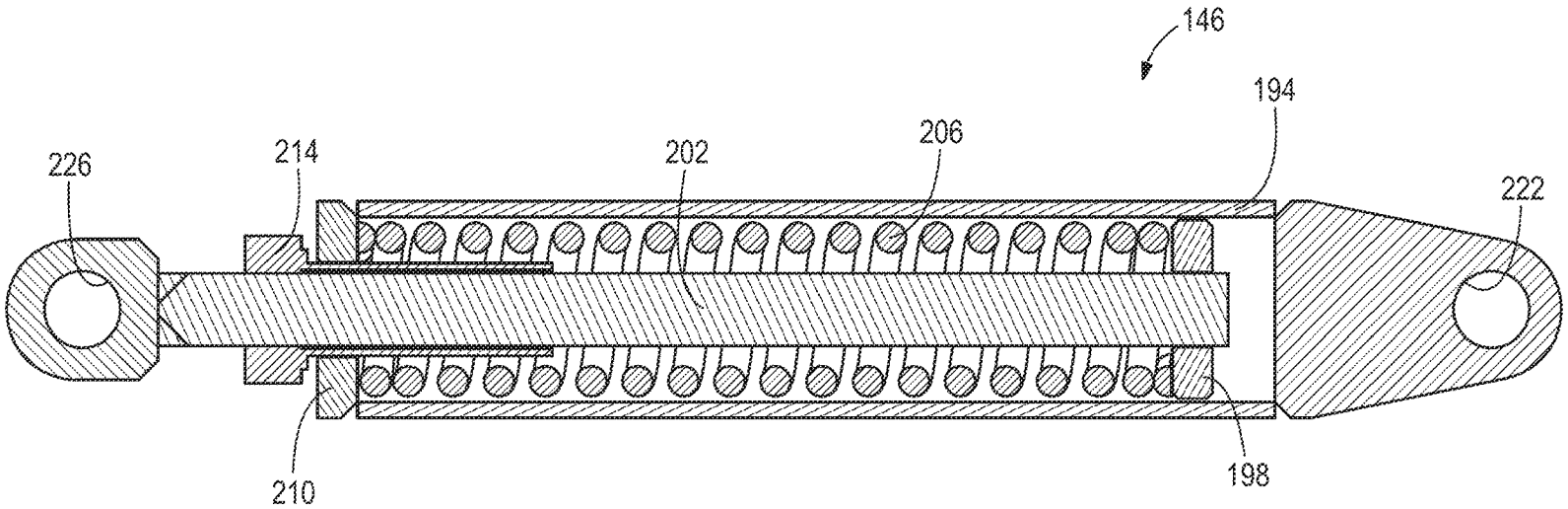
FIG. 12 is a cross-section view of a strut, viewed along section 12-12 of FIG. 6.

As shown in FIG. 12, in the illustrated embodiment the second struts 146 are pre-tensioned shock absorbers. Although only the second struts 146 are shown in detail, it is understood that the first struts 142 may have similar (if not identical) structure and characteristics. Each second strut 146 includes a barrel or body 194, a piston 198 coupled to a rod 202, and a spring 206 positioned within the body 194 between an end 210 of the body 194 and the piston 198. When the rod 202 is extended or pulled away from the body 194, the piston 198 compresses the spring 206 and induces a biasing force that biases the rod 202 toward an initial position. The struts 146 may be pre-tensioned by threading a nut 214 on the rod 202 against the end 210 of the body 194, thereby compressing the spring 206 against the piston 198. In one embodiment, each strut 146 is pre-tensioned and then the eyes 222, 226 are pinned into place between the boom 90 and the joint 110, and the nut 214 of each strut 146 is slightly unthreaded so that the pre-tension is transmitted to the boom 90. In other embodiments, the struts may include a damper element (e.g., a fluid damper) for dampening motion of the second portion 106 relative to the first portion 102.

The pivoting movement of the second portion 106 provides shock absorption of the boom 90, allowing the boom 90 to move relative to the cutting assembly 18 (e.g., in forward and backward directions) when an oblique load or an impact load exerted on the boom 90 exceeds a predetermined level. The predetermined level may be based on the pre-tension force applied on the struts 142, 146. This impact load may be caused by, among other things, a slab or piece of cut material transported on the face conveyor 70 proximate the chassis 14. In addition, the struts 142, 146 bias the second portion 106 toward the neutral position when the transverse load on the boom 90 is below the predetermined level, thereby performing a self-centering function to maintain the spray nozzles 126 in a desired location relative to the cutter head 38 to suppress dust and/or ignition. Because the boom 90 can move, the boom 90 is better able to absorb dynamic loads or shocks and is less likely to break, thereby increasing the working life of the boom 90.

Although aspects have been described in detail with reference to certain preferred embodiments, variations and modifications exist within the scope and spirit of one or more independent aspects as described.

What is claimed is:

1. A mining machine comprising:

a chassis including a first end, a second end, and a chassis axis extending between the first end and the second end, the chassis movable in a direction parallel to the chassis axis;

a first cutting assembly coupled to the chassis, the first cutting assembly including a first arm and a first cutting drum supported by the first arm for rotation relative to the first arm, the first cutting drum including a plurality of first cutting elements;

a second cutting assembly coupled to the chassis, the second cutting assembly including a second arm and a second cutting drum supported by the second arm for rotation relative to the second arm, the second cutting drum including a plurality of second cutting elements; and a spray arm pivotably coupled to the chassis and positioned proximate the first cutting assembly, the spray arm including a first end, a second end, and a joint supporting the spray arm second end for pivoting movement relative to the spray arm first end about a wrist axis, the first end pivotable relative to the chassis about a spray arm pivot axis oriented transverse to the chassis axis, the spray arm further including at least one spray nozzle for emitting a fluid spray in a region adjacent the first cutting assembly, a first portion proximate the spray arm first end, a second portion proximate the spray arm second end, the joint coupling the first portion and the second portion, a first biasing member, a second biasing member, the first biasing member coupled between the joint and the first portion, the second biasing member coupled between the joint and the second portion, the first biasing member and the second biasing member biasing the second portion toward a neutral position.

2. The mining machine of claim 1, wherein the spray arm is a first spray arm, and further comprising a second spray arm pivotably coupled to the chassis and positioned proximate the second cutting assembly, the second spray arm including a first end and a second end, the first end of the second spray arm pivotable relative to the chassis about a second spray arm pivot axis oriented transverse to the chassis axis, the second spray arm further including at least one spray nozzle for emitting a fluid spray in a region adjacent the second cutting assembly.

3. The mining machine of claim 1, wherein the spray arm defines a spray arm axis extending between the spray arm first end and the spray arm second end, wherein the at least one spray nozzle includes a plurality of spray nozzles aligned with one another in a direction parallel to the spray arm axis.

4. The mining machine of claim 1, wherein the spray arm is pivotable relative to the chassis independently of the first arm of the first cutting assembly.

5. The mining machine of claim 1, wherein the wrist axis is laterally offset from the spray arm pivot axis and oriented perpendicular to the spray arm pivot axis.

6. The mining machine of claim 1, wherein each of the first and second cutting drums is positioned adjacent a first side of the chassis, wherein the spray arm is positioned between one of the cutting drums and a second side of the chassis that is opposite the first side, wherein the second portion of the spray arm is pivotable in a first direction toward the one cutting drum and in a second direction away from the one cutting drum.

7. The mining machine of claim 1, wherein the joint includes a first side and a second side opposite the first side, the first side including a first lug pivotably coupled to the first portion, the second side including a second lug pivotably coupled to the second portion.

8. The mining machine of claim 1, wherein the wrist axis is a first wrist axis, wherein the second portion is pivotable relative to the first portion in a first direction and a second direction opposite the first direction, wherein the second portion pivots in the first direction about the first wrist axis and pivots in the second direction about a second wrist axis offset from the first wrist axis.

9. A mining machine comprising:

a chassis including a first end, a second end, and a chassis axis extending between the first end and the second end, the chassis movable in a direction parallel to the chassis axis;

a cutting assembly coupled to the chassis, the cutting assembly including an arm and a cutting drum supported by the arm for rotation relative to the arm, the cutting drum including a plurality of cutting elements; and a spray arm coupled to the chassis and positioned proximate the cutting assembly, the spray arm including a first portion, a second portion pivotably coupled to the first portion, and at least one spray nozzle for emitting a fluid spray in a region adjacent the cutting assembly, the first portion pivotally coupled to the chassis and extending away from the chassis along a spray arm axis, the second portion pivotable relative to the first portion about a wrist axis, the spray arm further including a joint coupling the first portion and the second portion, a first biasing member, and a second biasing member, the first biasing member coupled between the joint and the first portion, the second biasing member coupled between the joint and the second portion, the first biasing member and the second biasing member biasing the second portion toward a neutral position.

10. The mining machine of claim 9, wherein the wrist axis is oriented perpendicular to the spray arm axis.

11. The mining machine of claim 9, wherein the chassis includes a first side and a second side opposite the first side, wherein the spray arm is positioned between the cutting drum and the second side of the chassis and the second portion of the spray arm is pivotable in a first direction toward the cutting drum and pivotable in a second direction away from the cutting drum.

12. The mining machine of claim 9, wherein the wrist axis is a first wrist axis, wherein the joint includes a first side and a second side opposite the first side, the first side including a first lug pivotably coupled to the first portion and defining the first wrist axis, the second side including a second lug pivotably coupled to the second portion and defining a second wrist axis.

13. The mining machine of claim 12, wherein the second portion is pivotable about the first wrist axis in a first direction and is pivotable about the second wrist axis in a second direction.

14. A spray system for a mining machine, the mining machine including a chassis and a cutting assembly pivotably coupled to the chassis, the spray system including:

an elongated base member including a first end, a second end, and an arm axis extending between the first end and the second end, the first end configured to be coupled to the chassis;

a distal member including a plurality of spray nozzles for emitting a fluid spray, the distal member being pivotable relative to the base member about a wrist axis that is perpendicular to the arm axis;

an intermediate portion positioned between the base member and the distal member, the intermediate portion including a first side and a second side opposite the first side, the first side pivotably coupled to the second end of the base member, the second side pivotably coupled to the distal member;

a first biasing member coupled between the first side of the intermediate portion and the base member; and a second biasing member coupled between the second side of the intermediate portion and the distal member, the first biasing member and the second biasing member biasing the distal member toward a neutral position relative to the base member.

15. The spray system of claim 14, wherein the wrist axis is a first wrist axis, and wherein the first side of the intermediate portion includes a first lug pivotably coupled to the base member and defining the first wrist axis, the second side of the intermediate portion including a second lug pivotably coupled to the distal member and defining a second wrist axis offset from the first wrist axis.

16. The spray system of claim 15, wherein the distal member pivots in a first direction and a second direction opposite the first direction, the distal member pivoting in the first direction about the first wrist axis and pivoting in the second direction about the second wrist axis.

17. The spray system of claim 16, wherein the distal member pivots about the first wrist axis through a first angle and pivots about the second wrist axis through a second angle.

18. The spray system of claim 15, wherein the first wrist axis and the second wrist axis are laterally offset from the arm axis, the first wrist axis positioned on one side of the arm axis and the second wrist axis positioned on an opposite side of the arm axis.

* * * * *